US006513584B2

(12) United States Patent
Lehmann et al.

(10) Patent No.: US 6,513,584 B2
(45) Date of Patent: Feb. 4, 2003

(54) PLATE HEAT EXCHANGER

(75) Inventors: Reinhard Lehmann, Wunstrof (DE); Uwe Hachmeister, Sarstedt (DE)

(73) Assignee: GEA Ecoflex GmbH, Sarstedt (DE)

( * ) Notice: Subject to any disclaimer, the term of this patent is extended or adjusted under 35 U.S.C. 154(b) by 0 days.

(21) Appl. No.: 09/911,093

(22) Filed: Jul. 23, 2001

(65) Prior Publication Data

US 2002/0074112 A1 Jun. 20, 2002

(30) Foreign Application Priority Data

Jul. 22, 2000 (DE) ..... 100 35 776

(51) Int. Cl.[7] ..... F28F 3/00
(52) U.S. Cl. ..... 165/166; 165/167; 165/DIG. 369
(58) Field of Search ..... 165/166, 167, 165/DIG. 367, DIG. 369; 411/501, 508, 510, 907

(56) References Cited

U.S. PATENT DOCUMENTS 2,995,328 A * 8/1961 Whitted ..... 248/71
3,842,565 A * 10/1974 Brown et al. ..... 16/86 R
4,377,204 A * 3/1983 Johansson ..... 165/166
4,432,415 A * 2/1984 Wright ..... 165/166
4,776,739 A * 10/1988 Hamman ..... 24/297
5,316,423 A * 5/1994 Kin ..... 411/339
5,727,620 A * 3/1998 Schaufele et al. ..... 165/166
5,988,268 A * 11/1999 Usami et al. ..... 165/166

FOREIGN PATENT DOCUMENTS

| | | | |
|---|---|---|---|
| EP | 0039229 | 11/1981 | |
| EP | 0123379 | 10/1984 | |
| EP | 0134155 | 3/1985 | |
| GB | 2071303 | 9/1981 | |
| GB | 2075656 | 11/1981 | |
| GB | 2145511 A * | 3/1985 | ..... F28F/3/10 |

* cited by examiner

*Primary Examiner*—Allen Flanigan
(74) *Attorney, Agent, or Firm*—Flanagan & Flanagan; John R. Flanagan

(57) ABSTRACT

A plate heat exchanger including adjoining plates disposed adjacent one another and having peripheral grooves and channels alternately for media giving off heat and absorbing heat, seals made of an elastic material each being emplaced between the adjoining plates in the groove of one of the plates, attachment holes in each plate, and nipples on each seal insertable in the holes and with cross-sections different from the penetration cross-sections of the holes such that the nipples when inserted into the holes are not compressed about their entire circumference but only at spaced sites thereon at which the nipples project beyond the margin of the holes. The holes are defined by downturned edges which have radii and point in the insertion direction of the nipples into the holes.

17 Claims, 3 Drawing Sheets

PLATE HEAT EXCHANGER

BACKGROUND OF THE INVENTION

1. Field of the Invention

The present invention relates to plate heat exchanger and, more particularly, is concerned with a plate thereof having attachment holes and a seal thereof having nipples with cross sections different from the penetration cross section of the holes such that the nipples when inserted into the holes are not pressed about their entire circumference but only at spaced sites thereon at which the nipples project beyond the margin of the holes.

2. Description of the Prior Art

Before the plates of a plate heat exchanger are suspended in a frame and pressed together to form a packet, seals are fixed in grooves which facilitates handling the plates during the assembly. A known manner of fastening the seals is adhering the seals in grooves by use of an adhesive means which for the sealing effect itself is irrelevant but rather the adhesive means serves for the correct fixing of the position of the seals on the plates. This adhesion technique has some disadvantages. For example, before the application of the adhesive means, the grooves must be cleaned of, for example, oil and fat residues in order for the adhesive effect not to be impaired. Subsequently the adhesive means itself must be applied. All of this is rather time-consuming. Problems are also encountered in the maintenance of plate heat exchangers when a seal needs to be replaced. For this purpose the old seal must be removed and subsequently the groove must be cleaned of the adhesive means. An inspection of the groove bottom and the seal is also only possible, for example after the cleaning work on the dismounted heat exchanger, if the adhesion connection is previously destroyed.

Due to these disadvantages and the fact that in some technical fields, such as for example in medicine and food, adhesive means are to be avoided as much as possible, plate heat exchangers have been developed in which the seals are fastened mechanically, thus without adhesive means, on the plates. One feasibility known in the relevant technology for adhesive means-free seal fastening is that elastic nipples or projections, integrally developed with the seals, are brought into press fit with associated holes or openings in the plates.

According to patent document Nos. GB 2 071 303 A, GB 2 075 656 A and EP 0 134 155 A1, the nipples should have over-dimensions relative to the holes such that they can readily be pressed into the holes and can be pulled out again. It is therein to ensure that the seal is fixed securely at the intended site. This solution entails problems since the nipples as well as the seal as cast parts are subject to tolerance fluctuations. If the radial over-dimension of the nipples is too large, they can only be pressed into the holes with difficulty or not at all. If this is, nevertheless, successful, the nipples tear off when the seal is removed, for example during inspection or cleaning work, such that the seal must be replaced by a new seal.

The problem of tolerances in the radial nipple dimensions is solved through a plate heat exchanger disclosed in patent document No. EP 0 039 229 A2. Here, the nipples are provided on webs disposed laterally to the seal and developed integrally with it, from which the nipples project downwardly. Through the webs extends a pocket hole into the nipples. To fasten the seal, the nipples are positioned above the holes on the plates which are associated with the nipples. Subsequently a pin or like tool is introduced into the pocket hole and the nipples are then stretched by pressure onto the pin such that they become significantly thinner and can be placed into the holes without any problems. After the removal of the pin the nipples contract again to their original dimension whereby the ends of the nipples inserted through the holes expand to form a head covering the hole from below. The seals are consequently fastened securely on the plates. Of disadvantage in this technique is that tools are necessary to press the nipples in the holes. Furthermore, during inspection or maintenance work requiring the removal of the seals, the above-described consequences occur, the tearing off of the nipples.

Lastly, patent document No. EP 0 123 379 B1 discloses a plate heat exchanger in which the seal is fastened on the plate by means of elastic projections integrally developed with it, which extend into associated openings in the groove bottom. The openings are developed such that they comprise an insertion and pull-out region into which the projections can freely be moved, and from which they can be moved out again, along the margin of the openings without force. From this region the projections can be moved into a blocking region of the openings, in which the motion of the projections into the openings, respectively out of them again, is counteracted by strong resistance by compression between the projections and the margins of the openings, wherein moving the projections from the insertion and pull-out position into the blocked position, and conversely, is possible due to the elasticity (resiliency) of the seal.

Consequently, a need exists for an innovation in a plate heat exchanger of the type described above which will overcome the aforementioned problems without introducing new problems in place thereof.

SUMMARY OF THE INVENTION

The present invention overcomes the aforementioned problems in a plate heat exchanger by providing a simple solution for the mechanical fastening of the seals on the plates, which solution nevertheless permits a secure hold of the seals on the plates and also a problem-free removal of the seals from the plates. Specifically, each plate has attachment holes and each seal on a given plate has nipples projecting therefrom with cross-sections different from the penetration cross section of the holes such that the nipples when inserted into the holes are not pressed about their entire circumference but only at spaced sites thereon at which the nipples project beyond the margin of the holes. Since the cross-sections of the nipples are smaller than the penetration area of the holes, at other sites there is still clearance between the circumference of the nipples and the margin of the holes. Due to the elasticity of the nipples, their compressed material can expand into these free volumes, which leads to a decrease of the compression and consequently facilitates pressing the nipples into the holes. Through this displacement mechanism overtolerance in the radial dimensions of the nipples is extremely well compensated or, expressed differently, it is possible to work with relatively greater radial over-dimensions than is possible with the prior art.

Accordingly, the present invention is directed to a plate heat exchanger which comprises: (a) a plurality of adjoining plates disposed adjacent one another so as to form a packet, the plates having peripheral grooves and a plurality of channels alternately for media giving off heat and absorbing heat, and inlet and outlet openings for passage of the media through the channels between the adjoining plates; (b) a plurality of seals made of elastic material, each of the seals being emplaced between the adjoining plates in the groove of one of the adjoining plates; and (c) means for mechanically fastening each of the seals on one of the plates. The fastening means includes a plurality of attachment holes defined in each of the plates and a plurality of nipples made of elastic material and being insertable in the holes, the nipples being integrally formed on each of the seals at intervals spaced longitudinally along the seal, the nipples having cross sections different from penetration cross sections of the holes such that the nipples when inserted into the holes are not compressed about the entire circumference of the nipples but only at spaced sites thereon at which the nipples project beyond margins of the holes such that due to the elastic material the nipples can compress radially and axially so as to permit the pressing-in and pulling-out of the nipples into or out of the holes.

More particularly, the nipples have one of a polygonal and circular cross section and the holes have the other of the polygonal and circular cross section. The margins of the holes are provided as annular downturned edges pointing in the direction of insertion of the nipples into the holes. This forming of the holes has various advantages. Thus, for one, the contact area between nipple and hole is increased. Thereby, the radial over-dimension of the nipples required according to the prior art can be decreased while maintaining a secure hold of the seal. This permits the nipples to be pressed into and pulled out of the holes more readily. For another, the immersion of the nipples into the holes is facilitated since the ends of the nipples when they are inserted into the holes run against an encompassing radius on the margin of the holes. This radius also permits providing a radius at the transition from nipple to seal. This, for one, has advantages with respect to fabrication engineering during the production of the seal and, for another, it reduces the danger of the nipples being sheared off at this site during movements of the plates.

The tips of the nipples have truncated conical shapes which facilitates inserting the nipples into the holes. Preferably, each of the nipples has a trigonal cross-sectional configuration and each of the holes has a circular configuration. Further, each of the nipples has three edges circumferentially spaced apart and rounded off.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
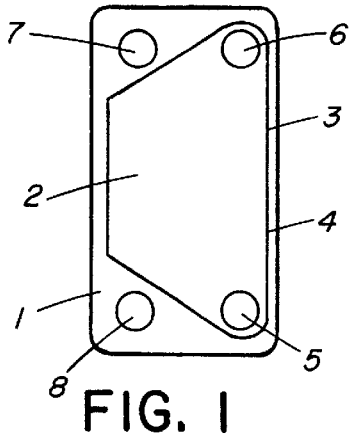
FIG. 1 is a schematic top plan view of a plate heat exchanger showing a plate according to the invention.

Referring to the drawings and particularly to FIG. 1, there is schematically illustrated a plate heat exchanger of the present invention having a plate 1 with a heat exchange area 2 which is framed by a seal 4 placed into a peripheral groove 3 and comprised of a synthetic rubber or another elastic sealing material. The plate 1 can be in the form of a sheet metal slab. At the corners of the plate 1 are provided inlet and outlet openings 5, 6, 7, 8 for the heat exchange media. While in the depicted plate 1 the inlet and outlet openings 5, 6 are encompassed by the seal 4, the seals and plates disposed in front and behind plate 1 which encompass the inlet and outlet openings 7,8 are now shown in FIG. 1. In such manner, the plates and seals are bundled into a packet such that alternately flow channels are formed for a medium giving off heat and a medium absorbing heat. The plate heat exchanger described thus far corresponds to the structure known from the prior art and therefore does not require further explanations.

Figure 2:
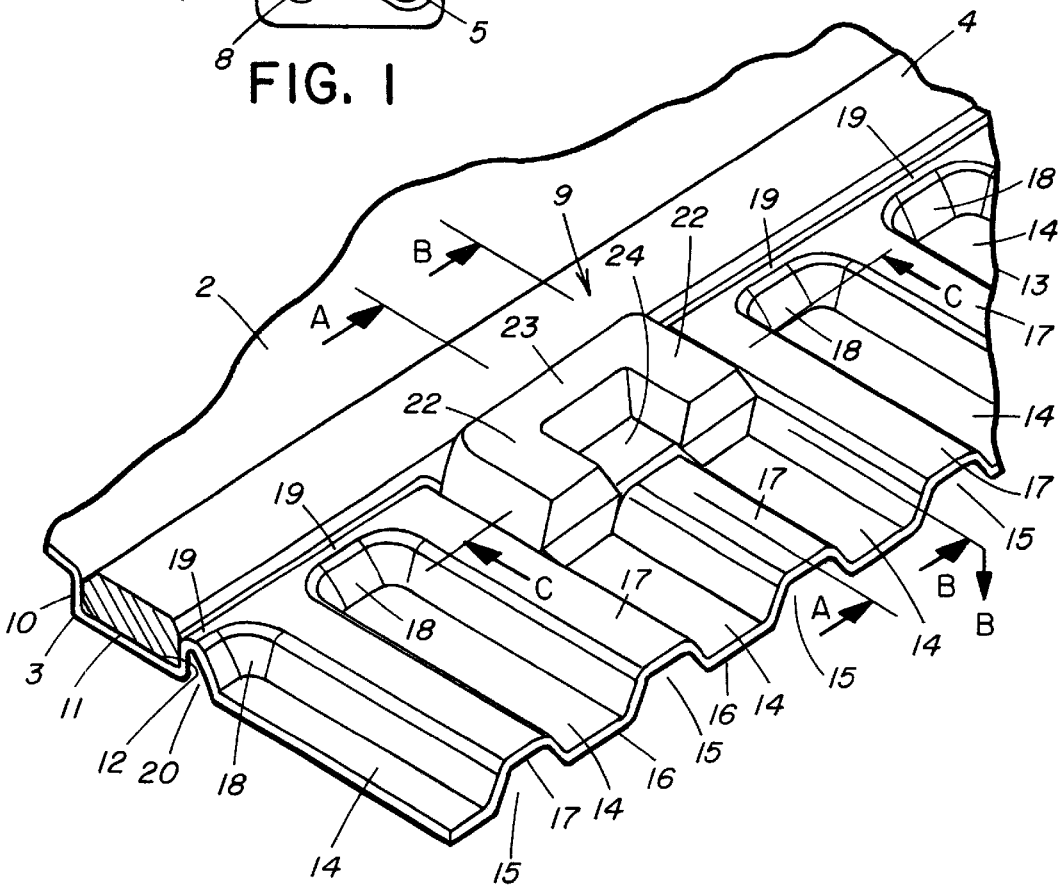
FIG. 2 is an enlarged fragmentary perspective view of a margin region of the plate with an emplaced seal.

Referring to the margin section of the plate 1 shown in FIG. 2, the seal 4 is shown fixed in the groove 3 without using any adhesive means. A second plate 1', depicted in FIGS. 3–5, has been omitted in FIG. 2 for reasons of clarity. For this purpose, on the side of the plate 1 facing away from the heat exchange area 2, there is provided a plurality of retaining parts 9 (only one shown) associated with the groove 3 and integrally formed with the seal 4. The retaining parts 9 are disposed at suitable intervals from one another on the circumference of the seal 4 and project laterally therefrom.

Figure 3:
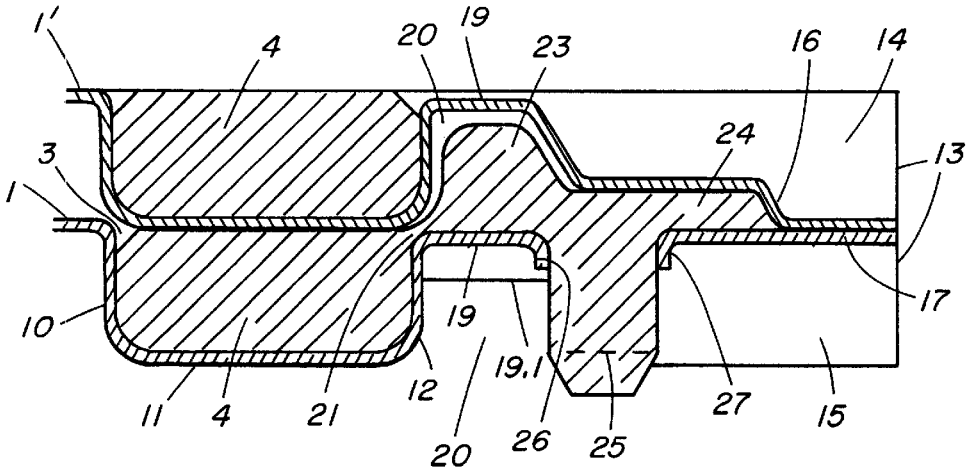
FIG. 3 is an enlarged sectional view taken along line A—A of FIG. 2 showing a second plate with the first plate and the inserted seals thereon.
Figure 4:
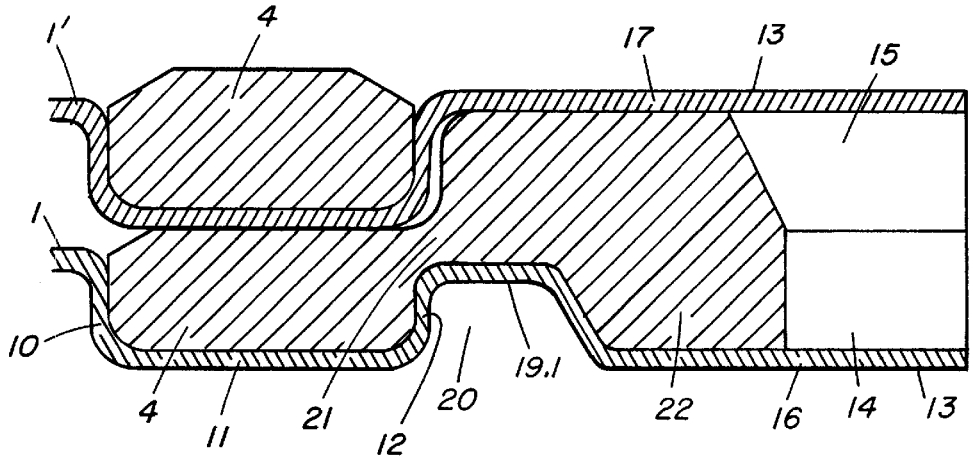
FIG. 4 is another enlarged sectional view taken along line B—B of FIG. 2 showing the first and second plate and inserted seals.

As is evident in FIGS. 2–4, the groove 3 is formed by an inner side wall 10 extending downwardly from the level of the heat exchange area 2, an outer side wall 12 extending upwardly again to the level of the heat exchange area 2 and a groove bottom 11 extending between and interconnecting the inner and outer side walls 10, 12. The outer side wall 12 is adjoined by a plate margin 13. This plate margin 13 is not at one level but rather is formed by channels 14 and 15 alternately opening upwardly and downwardly as well as outwardly and having the form of a trapezoid in cross section. Channels 14 have bottoms 16 at the level of the groove bottom 11 and channels 15 have bottoms 17 at the level of the heat exchange area 2 so as to form the plate margin 13 with a "corrugation" configuration. The channels 14 define troughs which are closed by front walls 18 adjacent to the groove 3. Bridges 19 are provided between the front walls 18 of channels 14 and the outer side wall 12 of the groove 3. The spaces 20 formed underneath these bridges 19 connect the channels 15 which extend up to the outer side wall 12 of groove 3 on the underside of plate 1.

Each retaining part 9 takes the form of a generally U-shaped web 21 which extends into two adjacent channels 14 and a channel 15 disposed inbetween. The web 21 is integrally connected with seal 4 along the entire width of the web 21 extending along the groove 3. As seen in FIGS. 3 and 4, the thickness of the web 21 is less in an intermediate portion 24 of the web 21 which overlies a region of bottom 17 of channel 15 adjacent to the channel 3 than in a bight portion 23 of the web 21 which overlies the bridges 19 between the two channels 14 and the outer side wall 12 of the groove 3 such that the web 21 is thereby reinforced at the end portion 23. In order to receive this reinforced bight portion 23 of the web 21, bridge 19.1 of channels 14 into which each retaining part 9 extends is provided, in comparison to the remaining bridges 19, are indented downwardly by the magnitude of the reinforcement provided by bight portion 23 such that the bridges 19.1 formed thereby have a lesser height above bottoms 16 of channels 14 than do the bridges 19.

Also, adjoining opposite ends of and extending transversely to the bight portion 23 of web 21 of each retaining part 9 is a pair of end extension portions 22 which extending away from the seal 4 and groove 3 with the channels 14 of the plate margin 13. The intermediate portion 24, adjacent to and connected with the bight portion 23, also extends between and interconnects the extension portions 22.

Figure 5:
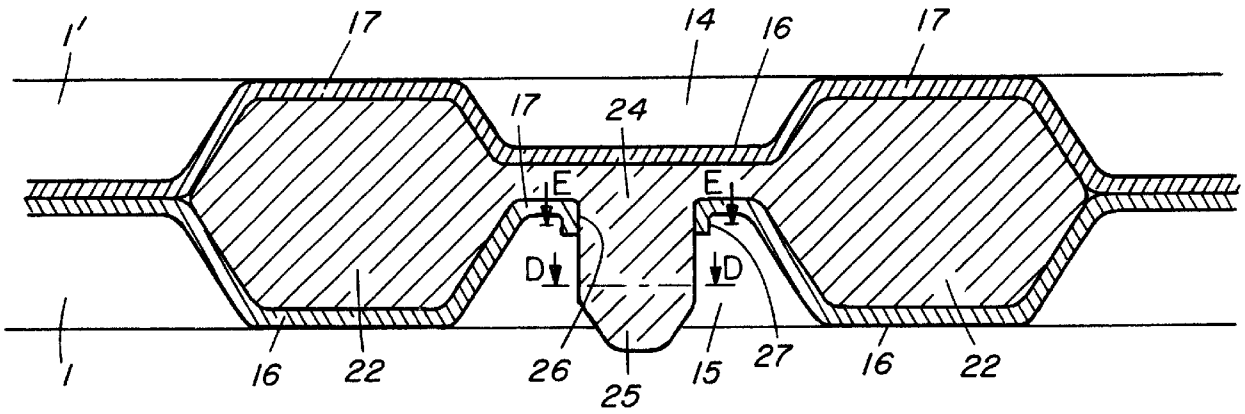
FIG. 5 is still another enlarged sectional view taken along line C—C of FIG. 2, extending substantially perpendicular to the sectional views of FIGS. 3 and 4, showing the first and second plates and inserted seals.

As seen in FIGS. 3–5, when installed the end extension portions 22 lie within the associated channels 14, while the intermediate portion 24 rests on the bottom 17 of the channel 15 disposed inbetween. As is evident in particular in FIG. 5, the cross sections of the extension portions 22 are selected such that they fill completely the hexagonal cross section formed by the channels 14 of plate 1 and the channels 15 of plate 1' being superimposed on the plate 1. In other words, the extension portions 22 are in contact formfittingly in the associated channels 14 and 15 of respective plates 1, 1' facing one another. Since the channels 14, 15 are open toward the outside, and thus toward the environment, the retaining parts 9 can expand in this direction, whereby thermal and mechanical stresses are reduced and thus deformations of the plate margin 18 are avoided.

FIGS. 3 and 5 together show that the bottom 16 of channel 14 of plate 1' which is disposed above the intermediate portion 24 of web 21, is raised in its rear region by the thickness of the intermediate portion 24 such that it conforms from above to the presence of the intermediate portion 24 of the web 21. It can also be seen in FIG. 3 that the transverse bight portion 23, after assembly, substantially fills the space 20 under bridge 19 of overlying plate 1'.

The above-described form-fit development of the retaining parts 9 with the plates 1, 1' covering the parts 9, stabilizes the orientation of the plates 1, 1' in the plate packet of the plate heat exchanger and prevents, or reduces, in cooperation with conventional metal guidance elements developed on the plates, movements of the plates 1, 1' in the plate plane, during operation of the plate heat exchanger, due to the internal pressure of the heat exchange media.

Since the retaining parts 9 and thus also seal 4 in the embodiment described so far rest only loosely on plate 1, measures for fastening must be taken in order for the seal 4 to be reliably fixed in the groove 3 to enable handling the plates during the assembly of the plate heat exchanger. For this purpose, a nipple 24, integrally formed with each retaining part 9, is provided, which projects downwardly and, with the seal 4 mounted in the groove 3, projects through a circular attachment hole 26 formed in plate 1. The margin of the hole 26 is developed as a draw-through feature having an annular downturned edge 27 pointing in the direction of insertion of the nipple 25. The radius of the annular downturned edge 27 facilitates inserting the nipple 25 into the hole 26. The transition of the nipple 25 to the intermediate portion 24 of the web 21 can simultaneously also be implemented with this radius. This provision of a radius on the downturned edge 27 about the margin of the hole 26 prevents, for one, the shearing forces acting on the nipple 25 by the margin of the hole 26 and facilitates, for another, the production of the nipple 25 since radii can be realized more readily in a casting mold. To further facilitate the insertion into the hole 26, the tip of the nipple 25 is provided in the configuration of a truncated cone.

Figure 7:
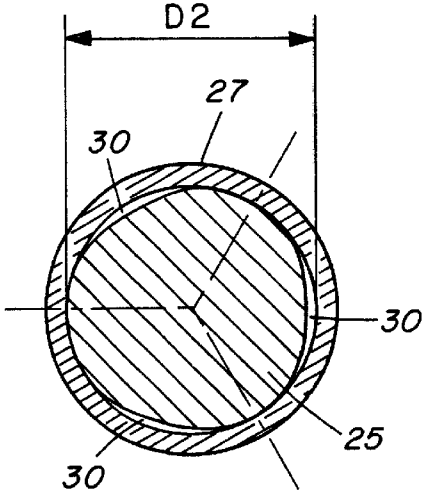
FIG. 7 is another enlarged cross-sectional view taken along line E—E of FIG. 5.
Figure 6:
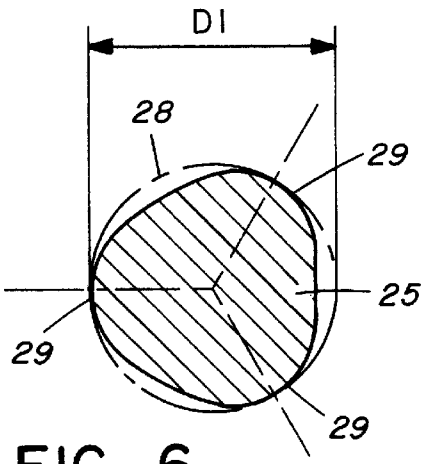
FIG. 6 is an enlarged cross-sectional view taken along line D—D of FIG. 5.

Referring to FIGS. 6 and 7, furthermore in contrast to the circular cross-sectional configuration of the hole 26, the nipple 25 has a trigonal cross-sectional configuration. The three edges 29 of the trigonal cross-sectional configuration of the nipple 25 are rounded off, as most clearly seen in FIG. 6. In FIG. 6, a circle 28 enveloping the cross-section of the nipple 25 is drawn in. Diameter D1 of the circle 28 shown in FIG. 6 is greater than the inner diameter D1 of the hole 26 shown in FIG. 7. But simultaneously the cross-sectional area of nipple 25 is smaller than the penetration cross section of the hole 26.

If, during the mounting of seal 4, the nipple 25 is pressed into hole 26, the nipple 25 becomes centered due to its conical tip and the radius of the downturned edge 27 of the hole margin itself. Simultaneously, the penetration of the nipple 25 into hole 26 is facilitated. When the nipple 25 is pressed in further, its material is compressed at the positions projecting over the inner diameter of the hole 26, which, in this case, are the rounded-off edges 29 of the nipple 25. But, due to its elasticity it can expand into the free volumes between the cross-section of nipple 25 and the downturned edge 27 of the hole 26. In FIG. 7, these free volumes are identified with the reference numeral 30. Since the material of nipple 25 thus has radial and axial freedom of flow, the pressing-in and pulling-out of nipple 25 into or out of the hole 26 is facilitated. Simultaneously the required clamp-fit of nipple 25 in hole 26 is ensured, which is even further improved due to the greater inner wall area of hole 26 provided by the downturned edge 27.

In implementing the invention, either the holes 26 can have a circular or polygonal penetration cross-sectional shape and the nipples 25 vice versa.

It is thought that the present invention and its advantages will be understood from the foregoing description and it will be apparent that various changes may be made thereto without departing from the spirit and scope of the invention or sacrificing all of its material advantages, the form(s) hereinbefore described being merely preferred or exemplary embodiment(s) thereof.

We claim:

1. A plate heat exchanger, comprising:

(a) a plurality of adjoining plates disposed adjacent one another so as to form a packet, said plates having peripheral grooves and a plurality of channels alternately for media giving off heat and absorbing heat, and inlet and outlet openings for passage of said media through said channels between said adjoining plates;

(b) a plurality of seals made of elastic material, each of said seals being emplaced between said adjoining plates in said groove of one of said adjoining plates; and (c) means for mechanically fastening each of said seals on one of said plates, said fastening means including a plurality of attachment holes defined in each of said plates and a plurality of nipples made of elastic material and being insertable in said holes, said nipples being integrally formed on each of said seals at intervals spaced longitudinally along said seal, said nipples having cross sections different from penetration cross sections of said holes such that said nipples when inserted into said holes are not compressed about the entire circumference of said nipples but only at spaced sites thereon at which said nipples project beyond margins of said holes such that due to said elastic material said nipples can compress radially and axially so as to permit the pressing-in and pulling-out of said nipples into or out of said holes.

2. The plate heat exchanger as claimed in claim 1, wherein said nipples have one of a polygonal and circular cross section and said holes have the other of said polygonal and circular cross section.

3. The plate heat exchanger as claimed in claim 1, wherein the margins of said holes are provided as annular downturned edges pointing in the direction of insertion of said nipples into said holes.

4. The plate heat exchanger as claimed in claim 3, wherein each of said annular downturned edges provide a radius at said margin of each of said holes.

5. The plate heat exchanger as claimed in claim 4, wherein each of said nipples has a radius at the transition from said nipple to said seal that substantially matches the radius of each of said annular downturned edges.

6. The plate heat exchanger as claimed in claim 1, wherein said nipples have tips of truncated conical shape.

7. The plate heat exchanger as claimed in claim 1, wherein each of said nipples has a trigonal cross-sectional configuration.

8. The plate heat exchanger as claimed in claim 7, wherein each of said holes has a circular configuration.

9. The plate heat exchanger as claimed in claim 7, wherein each of said nipples has three edges circumferentially spaced apart and rounded off.

10. A plate heat exchanger, comprising:

(a) a plurality of adjoining plates disposed adjacent one another so as to form a packet, said plates having peripheral grooves and a plurality of channels alternately for media giving off heat and absorbing heat, and inlet and outlet openings for passage of said media through said channels between said adjoining plates;

(b) a plurality of seals made of elastic material, each of said seals being emplaced between said adjoining plates in said groove of one of said adjoining plates; and (c) means for mechanically fastening each of said seals on one of said plates, said fastening means including a plurality of attachment holes defined in each of said plates by annular downturned edges formed in said plates, and a plurality of nipples made of elastic material and being insertable in said holes in the direction of said downturned edges, said nipples being integrally formed on each of said seals at intervals spaced longitudinally along said seal, said nipples having cross sections different from penetration cross sections of said holes such that said nipples when inserted into said holes are not compressed about the entire circumference of said nipples but only at spaced sites thereon at which said nipples project beyond margins of said holes such that due to said elastic material said nipples can compress radially and axially so as to permit the pressing-in and pulling-out of said nipples into or out of said holes.

11. The plate heat exchanger as claimed in claim 10, wherein said nipples have one of a polygonal and circular cross section and said holes have the other of said polygonal and circular cross section.

12. The plate heat exchanger as claimed in claim 10, wherein each of said annular downturned edges provide a radius at said margin of each of said holes.

13. The plate heat exchanger as claimed in claim 12, wherein each of said nipples has a radius at the transition from said nipple to said seal that substantially matches the radius of each of said annular downturned edges.

14. The plate heat exchanger as claimed in claim 10, wherein each of said nipples has a tip of truncated conical shape.

15. The plate heat exchanger as claimed in claim 10, wherein each of said nipples has a trigonal cross-sectional configuration.

16. The plate heat exchanger as claimed in claim 10, wherein each of said holes has a circular configuration.

17. The plate heat exchanger as claimed in claim 16, wherein each of said nipples has three edges circumferentially spaced apart and rounded off.

* * * * *